US005144792A

United States Patent [19]

Lange et al.

[11] Patent Number: 5,144,792

[45] Date of Patent: Sep. 8, 1992

[54] CAGE-TYPE STRANDING MACHINE

[75] Inventors: Rüdiger Lange, Neuss; Helmut Classen, Würselen, both of Fed. Rep. of Germany

[73] Assignee: Stolberger Maschinenfabrik GmbH & Co. KG, Stolberg, Fed. Rep. of Germany

[21] Appl. No.: 488,097

[22] Filed: Mar. 5, 1990

[30] Foreign Application Priority Data

Jul. 12, 1989 [DE] Fed. Rep. of Germany ..... 3922862

[51] Int. Cl.[5] ..... D01H 7/02; D01H 7/46

[52] U.S. Cl. ..... 57/59; 57/264

[58] Field of Search ..... 57/6, 13, 65, 62, 59, 57/264, 309, 314, 58.32, 58.34, 58.36, 58.38, 60; 138/172

[56] References Cited

U.S. PATENT DOCUMENTS

| | | | |
|---|---|---|---|
| 2,674,857 | 4/1954 | Fortes | 138/172 |
| 2,873,569 | 2/1959 | Schinke et al. | 57/58.32 |
| 2,921,428 | 1/1960 | Lutcke et al. | 57/59 |
| 3,130,754 | 4/1964 | Bratz | 57/13 |
| 3,234,721 | 2/1966 | Carter | 57/65 X |
| 3,319,412 | 5/1967 | Winter et al. | 57/59 |
| 3,393,503 | 4/1968 | Lucas | 57/94 |
| 3,651,629 | 3/1972 | Webster | 57/13 |
| 4,253,298 | 3/1981 | Varga | 57/13 |
| 4,392,342 | 7/1983 | Meijer | 57/264 |
| 4,903,473 | 2/1990 | Classen et al. | 57/15 |

FOREIGN PATENT DOCUMENTS

| | | |
|---|---|---|
| 0207741 | 3/1984 | Fed. Rep. of Germany . |
| 482311 | 7/1916 | France . |

*Primary Examiner*—Daniel P. Stodola
*Assistant Examiner*—John F. Rollins
*Attorney, Agent, or Firm*—Spencer, Frank & Schneider

[57] ABSTRACT

A cage-type stranding machine includes a rotatably mounted supporting pipe (6) and radially outwardly oriented longitudinal webs (7) attached to the supporting pipe and distributed uniformly around its circumference, resulting in greater stiffness which permits higher rpm. Spool carriers (9) are rotatably supported by supporting shields (12), which are attached to the longitudinal webs. The supporting shields and the rotation axes (13) of the spool carriers are arranged at an angle to the supporting pipe to reduce the rotation circle diameter, which again permits an increased rpm in operation so that the production output can be increased.

22 Claims, 2 Drawing Sheets

FIG. 1
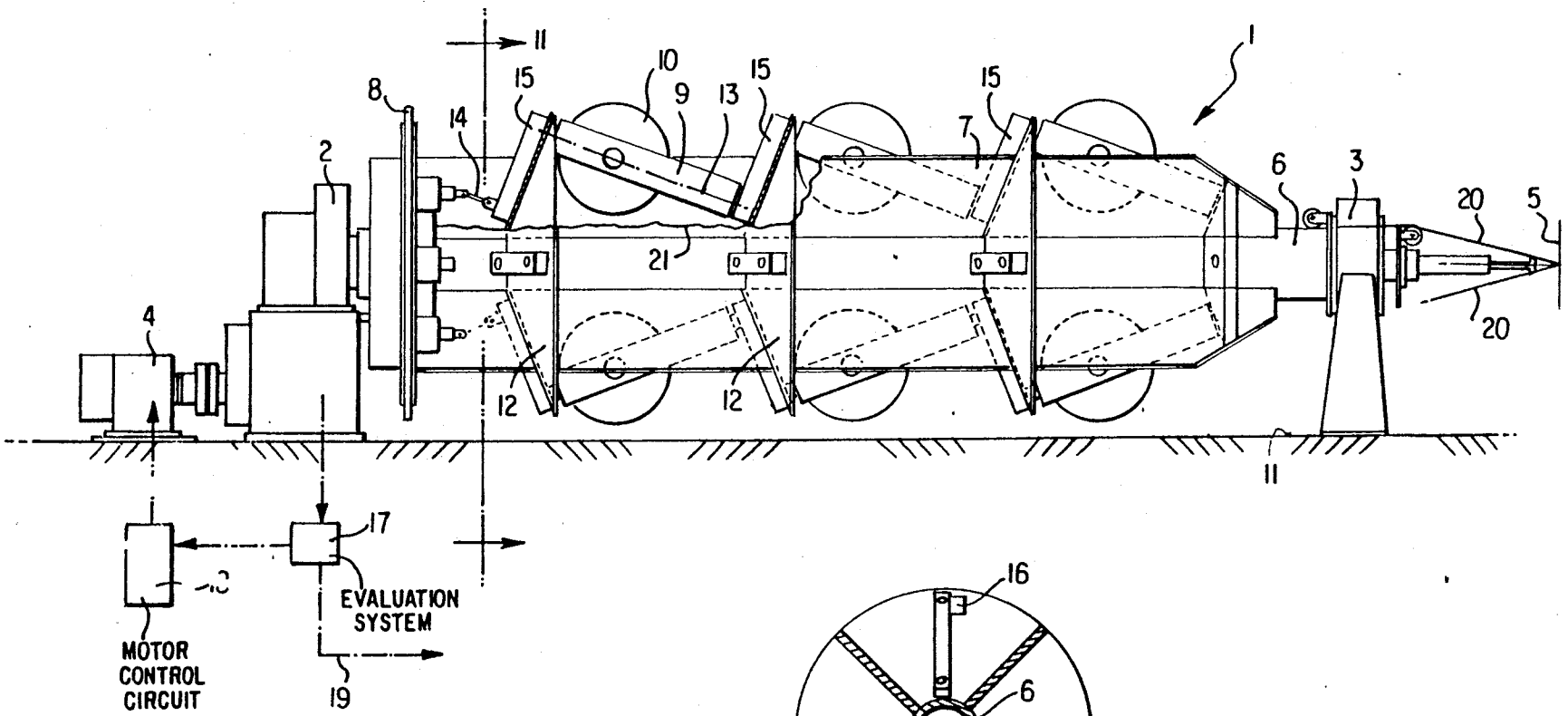
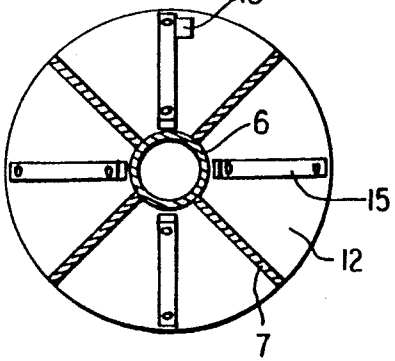
FIG. 2

CAGE-TYPE STRANDING MACHINE

CROSS REFERENCE TO RELATED APPLICATIONS

This application claims the priority of application Ser. No. P 39 22 862.2, filed Jul. 12, 1989 in the Federal Republic of Germany, the subject matter of which is incorporated herein by reference. Furthermore the subject matter of this application is related to that of U.S. application Ser. No. 07/239,583, filed Sep. 1, 1988 (now U.S. Pat. No. 4,903,473) the subject matter of which is also incorporated herein by reference.

BACKGROUND OF THE INVENTION

The present invention relates to a cage-type stranding machine of the type which includes a rotor equipped with a throughgoing supporting pipe rotatably mounted at both ends and supporting, concentrically with the rotor axis, several spool carriers holding spools for the filaments to be stranded in a manner so as to be rotatable and drivable.

In cage-type stranding machines of the above-mentioned type at least two circular plates, depending on the number of spool carriers required, are disposed at the supporting pipe. The spool carriers are held in these plates so as to. rotate about their longitudinal axes. The longitudinal axes of the spool carriers are oriented parallel to the rotor axis while the axes of rotation of the spools held by the spool carriers extend perpendicularly thereto. Between the two carrier plates, several spool carriers are arranged in uniform distribution about the circumference. These spool carriers are coupled with one another by way of a drive system so that they revolve relative to the rotor if the rotor rotates. This generally occurs in such a way that, with the rotor rotating, the axes of the spools remain oriented parallel to one another and parallel to the plane of the floor.

Due to the dimensions of the spools, the axes of rotation of the spool carriers must be placed at a considerable distance from the supporting pipe so as to even permit the above-described position relative to the rotor. This results in a considerable total diameter for the rotor as a whole, which ultimately leads to limitations regarding size and stability of the stranding machine.

Since the free space required for the rotary movement of the spool carriers, and the limitation on the total diameter of the rotor, require that certain limits be maintained, the diameter of the supporting pipe (which is decisive for the stability of the rotor) cannot be enlarged at will. The entire system becomes sensitive to bending vibrations, so that there are limitations with respect to the highest permissible rpm.

SUMMARY OF THE INVENTION

It is an object of the invention to provide a cage-type stranding machine of the above-mentioned type which has a much stiffer rotor and thus permits higher operating speeds.

This is accomplished according to the invention in that the supporting pipe is provided with at least three radially outwardly oriented longitudinal webs which extend in the longitudinal direction and are uniformly distributed over the circumference of the pipe. Seen in the longitudinal direction, the supporting pipe is provided with at least two spaced supporting shields which extend in at least two planes of rotation (that is, there are at least two supporting shields fixed to the supporting pipe and spaced apart to one another, are fixed to the longitudinal webs, and provide a support for the spool carriers. By using such longitudinal webs and the supporting shields fixed to them, it is possible to employ a supporting pipe having a relatively small diameter and simultaneously increase the bending strength of the rotor as a whole. The bending encountered during operation, caused by the weight of the rotor and/or residual imbalances which cannot be entirely compensated, is thus reduced so that a significantly higher rpm can be achieved with such a stiffened rotor, and thus the production output of the machine can be increased.

The term "plane of rotation," as used herein, means a plane which is perpendicular to the axis of the supporting pipe and which passes through the path swept out by a designated object attached to the supporting pipe, directly or indirectly, as the supporting pipe rotates.

As a particularly advantageous feature of the invention, it is further provided that the axes of rotation of the individual spool carriers mounted between two supporting shields that are adjacent one another in the longitudinal direction of the supporting pipe are oriented at an angle to the rotation axis of the supporting pipe, with the bearings of the spool carriers in one of the supporting shields being disposed at a relatively great distance from the supporting pipe and with the bearings of the spool carriers in the other supporting shield being disposed at a relatively small distance from the supporting pipe. The resulting oblique position of the spool carriers reduces the diameter of the rotation circle of the rotor without adversely influencing the free rotatability of the spool carriers relative to the rotor (since spools of a given size can be located closer to the supporting pipe without bumping into it as the spool carriers rotate, particularly for spools that are long in comparison with their diameters, if the spool carriers are positioned obliquely rather than parallel to the supporting pipe), so that the centrifugal forces acting on the rotor are reduced and thus the operating conditions are improved at high rotor rpm.

Another special advantage of such a cage-type stranding machine resulting from the reduced rotation circle diameter is that the machine can be set up at any desired location in the production sequence. While the prior art systems necessitated placement in a ditch of about 70 cm due to their large diameter, this requirement is eliminated by the invention because of the reduction of the rotation circle diameter. Advisably, the ends of the spool carriers facing the stranding point are mounted at a small distance from the supporting pipe. Thus, the filaments to be stranded and coming from the spools can be guided to the stranding point through respective openings in the supporting shields in the immediate vicinity of the supporting pipe. The filaments can be brought past the subsequent spool carrier without problems.

A further feature of the invention is that, with respect to each plane of rotation, a supporting shield is disposed between two adjacent longitudinal webs; the individual supporting shields are oriented at an angle to the supporting pipe axis; and the edges of the supporting shields on the side of the supporting pipe extend along a circumferential path and the outer edges of the supporting shields extend along another circumferential path. This arrangement has the advantage that the spool carrier bearings provided on the supporting shields, and elements of the drives required for rotation of the spool carriers relative to the rotor, are all oriented perpendicularly to the plane of the supporting shields, thus simplifying manufacture. Moreover, the sloping position of each individual supporting shield associated with a spool carrier permits a further, although slight, reduction of the diameter.

Another advantageous feature of the invention is that, in the region of at least one spool carrier, a measuring sensor is provided for picking up the centrifugal force generated by the spool of the spool carrier in question. This sensor communicates with a system for controlling the rpm of the stranding machine and of the removal system for the stranded filaments. With the aid of this feature, it is possible to run the machine at a lower number of revolutions at the beginning of a stranding job, when the spools are relatively full, and then, with decreasing coil diameter on the spools, to increase the rpm of the rotor. The centrifugal force acting on the spool bodies is a measure of the reduction of the coil diameter and constitutes a parameter according to which the rpm of the rotor and the removal velocity can be regulated. In this connection, it is sufficient to measure the centrifugal force at only one spool since, in principle, all spools receive the same amount of stranded filament, if possible. However, it is advisable to employ that spool which has the greatest starting weight in the spool carrier at the measuring location. In this way it is possible to always operate the stranding machine in the optimum rpm range. The stranding machine is initially started up at a starting rpm determined by a predetermined centrifugal force. Then the rpm increases progressively until the permissible maximum rpm is reached, which may be maintained until the end of the stranding job so that, as a whole, a considerable increase in production results with improved quality of the product. Wire brakes are practically eliminated. The centrifugal force measurement can be made without any moving parts if a so-called electrical pressure pickup is incorporated as the measuring sensor in the bearing of one of the spool carriers. The measured signal can be transmitted either by way of a slip ring or without contact by way of a transmitter. Depending on the type of drive employed for the stranding machine and the removal or wind-up devices, the measurement and change of rotor rpm and removal speed can be effected continuously or can be adjusted at given time intervals.

A further advantage of the invention is that the machine does not require any additional selector circuits with which it would have to be set up for different materials to be stranded. Thus, the stranding machine can be loaded, without any switching measures whatsoever, first with filaments of a heavy material such as copper, and thereafter with filaments of a lighter material such as aluminum. This is insignificant for the control process since the use of a predetermined centrifugal force as the guiding parameter automatically produces the appropriate rotor rpm. Due to the constant centrifugal stresses, the machine (along with the spools and spool bearings) will be stressed much less as a whole, so that much less wear occurs. Moreover, since the machine moves at a slower rpm at the beginning of the stranding job, smaller drive motors can also be used. Consequently, the brakes for the stranding basket may also have smaller dimensions. An advisable feature of the invention is that the measuring sensor is provided at a spool carrier bearing which is located at a relatively great distance from the supporting pipe.

BRIEF DESCRIPTION OF THE DRAWINGS

FIG. 1 is a side view schematically illustrating a stranding machine in accordance with the present invention.

FIG. 2 is a sectional view along line II—II of FIG. 1.

DESCRIPTION OF THE PREFERRED EMBODIMENT

Figure 3:
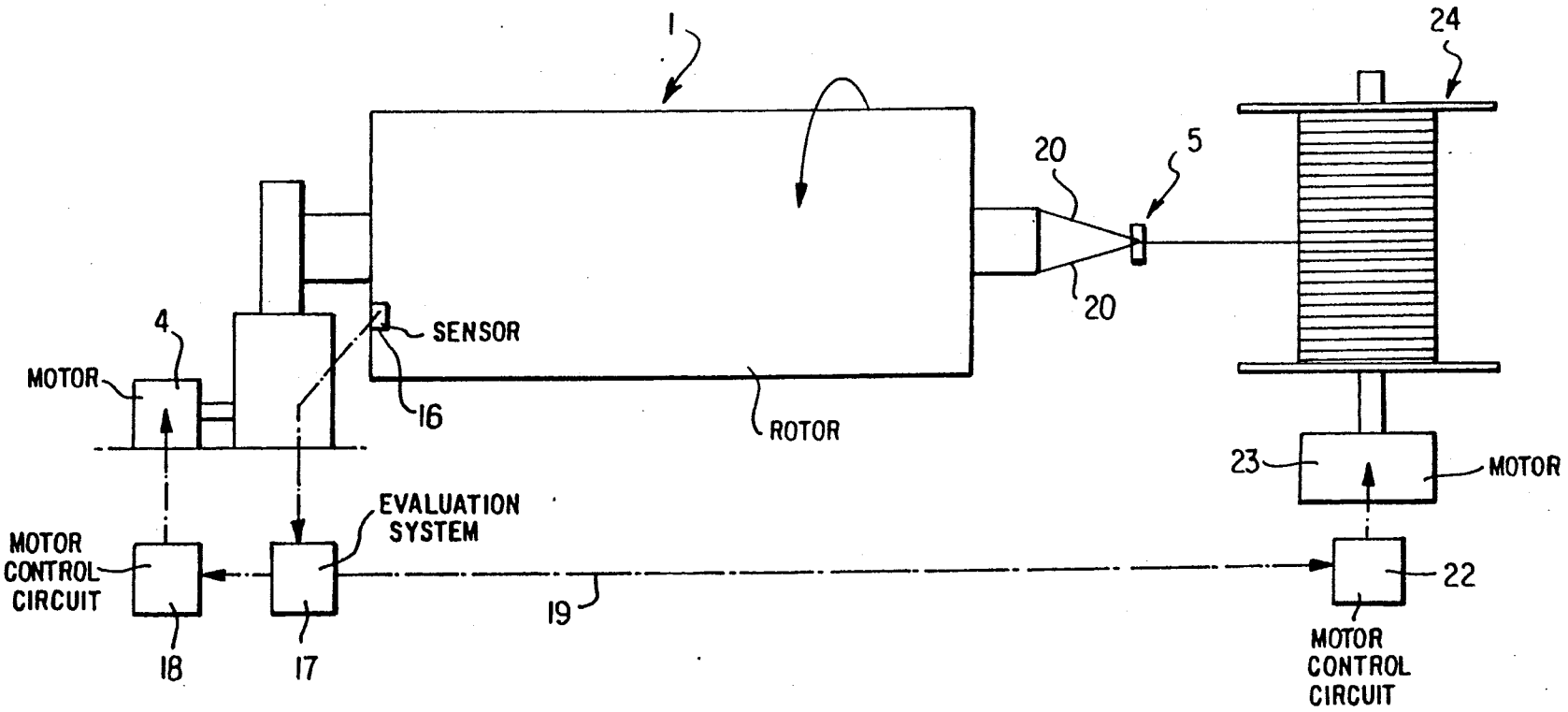
FIG. 3 schematically shows the complete stranding unit with a removal device for the stranded material.

In the illustrated embodiment, the ends of a rotor 1 are rotatably mounted in bearing blocks 2 and 3. Bearing block 2 includes a transmission mechanism (not illustrated) which communicates with a drive motor 4. Although not shown, bearing block 3 has apertures for passage of filaments 20. On the side of bearing block 3 facing away from rotor 1, there is a stranding point 5 where the filaments to be stranded are twisted into a cable.

Rotor 1 includes a supporting pipe 6 and four longitudinally extending, radially outwardly oriented webs 7, which are distributed at 90° intervals over the circumference of the pipe 6. The end of rotor 1 facing bearing block 2 is provided with a gear head 8 which includes transmission mechanisms (not illustrated) required for cage-type stranding machines employing reverse movement. A planetary gear arrangement such as that disclosed in U.S. Pat. No. 4,574,574 (which is incorporated herein by reference) may be employed. The individual spool carriers 9 and their spools 10 are driven by the transmission mechanisms of gear head 8 in such a manner that, during rotation of pipe 6, the axes of rotation of spools 10 remain in a parallel orientation relative to one another and to the floor 11 of the building.

Supporting shields 12 are disposed between longitudinal webs 7. The supporting shields 12 are oriented at an oblique angle to the axis of supporting pipe 6 and are fixed to longitudinal webs 7. The supporting shields 12 may be flat plates, as shown, or frustoconical members.

In the illustrated embodiment, only the spool carriers 9 and their spools 10 at the top and bottom are shown. The spool carriers facing the observer are omitted for the sake of easier illustration, and one of the webs 7 is partially broken away as indicated at 21. As can be seen in FIG. 1, spool carriers 9 and their axes of rotation 13 are oriented at an angle relative to the axis of the supporting pipe 6, with the axes of rotation !3 of the spool carriers 9 being oriented perpendicular to supporting shields 12.

The driving energy for spool carriers 9 is received from gear head 8 via cardan shafts 14 (which include simple universal joints). The driving energy is transferred, by way of chain or toothed-belt drives 15, here shown only schematically, from each supporting shield 12 to the next following spool carrier 9.

In the illustrated embodiment, four spool carriers 9 are arranged in one rotational plane, so that a total of twelve spool carriers 9 are provided on the rotor 1. Although not shown, the filament 20 taken from each spool 10 is guided inward toward the periphery of pipe 6 and is there diverted by a roller and guided parallel to supporting pipe 6 through an aperture in bearing block 3 to stranding point 5.

As indicated schematically in FIG. 2, a measuring sensor 16, for example in the form of a so-called pressure pickup, is arranged in the bearing of a spool carrier 9 and senses centrifugal force from the spool carrier 9 and its spool 10 that act on the bearing if rotor 1 rotates. As in the above-noted related application (now U.S. Pat. No. 4,903,473), a strain gauge which supports the bearing outwardly, in the radial direction, may be used to sense the centrifugal force. The measurement signal is conveyed by means not illustrated (including, for example, a slip ring transmitter in the region of bearing block 2) to an electronic evaluation system 17 which is, in turn, connected to a motor control circuit 18 for regulating the revolutions of drive motor 4. The evaluation system 17 is set to a fixed desired value for the centrifugal force and the rpm of the drive motor 4 is varied, on the basis of the deviation between the actual value measured by the measuring sensor 16 and the predetermined desired value, so as to reduce the deviation to zero and thereby maintain the centrifugal force at the desired value. Since the weight of a spool 10 decreases the longer a stranding job has lasted, the rpm of drive motor 4 must be increased to keep the centrifugal force at the desired value. The lay of the stranded filaments 20 forming the cable should remain practically constant over the entire length of the cable, so it is necessary to increase the rate at which the filaments 20 are pulled through the system by increasing the rpm of the drive motor (not illustrated) for the removal system (not illustrated). The linkage to the drive motor for the removal system is provided by an output signal from evaluation system 17, as indicated by the arrow 19. Such an arrangement makes it possible, after an initially low rpm of about 120 rpm at the beginning of the stranding job and a removal rate of about 68 m/min, to constantly increase the rpm of the machine so that finally a maximum speed of about 180 rpm (permissible for the machine in question) is realized. As a whole, this results in an average removal velocity for the finished cable of about 85 m/min, and a maximum removal velocity of about 100 m/min.

While a stranding machine according to the invention and employing the described regulation is subjected to a centrifugal force of only 65% of the allowed maximum centrifugal force, operation without the described rotation (that is, with an essentially constant rotor rpm) would require the absorption of the allowed maximum centrifugal force that is 100% for the same production output. This comparison of numbers alone shows that, with the described regulating process, the driving power to be installed and the construction costs for all bearings and for the cage brake (not shown) can be reduced considerably.

As shown in FIG. 3 the output signal (arrow 19) of the evaluation system 17 is connected to a motor control circuit 22 for regulating the revolutions of drive motor 23 of a removal device 24, by which the stranded material is wound up with an increasing speed, depended to the increasing speed of production of the stranding machine.

It will be understood that the above description of the present invention is susceptible to various modifications, changes, and adaptations, and the same are intended to be comprehended within the meaning and range of equivalents of the appended claims.

What we claim is:

1. A cage-type stranding machine for use with spools of filaments which are to be stranded, the machine having a standing point where the filaments converge, comprising:

a rotatably mounted supporting pipe having first and second ends and having an axis which runs through the first and second ends, the stranding point of the stranding machine being adjacent the first end of the pipe;

means for providing a first support which is connected to the pipe and which encircles the pipe, the first support being configured so that a cross section taken through the first support, along a plane containing the axis of the pipe, has two straight segments that are symmetrical with respect to the axis of the pipe and that are inclined so as to be oriented at an angle other than 90° to the axis of the pipe;

means for providing a second support which is connected to the pipe and which encircles the pipe, the second support being spaced apart from the first support and being configured so that a cross section taken through the second support, along said plane containing the axis of the pipe has two straight segments that are symmetrical with respect to the axis of the pipe and that are inclined so as to be oriented at said angle other than 90° to the axis of the pipe;

means for providing a plurality of longitudinal webs which extend in the longitudinal direction of the pipe and which have inner edges abutting the pipe, the webs being oriented radially outwardly from the pipe and being distributed uniformly about the circumference of the pipe, each web being connected to the first support and to the second support; and a plurality of spool carriers for the spools, each spool carrier being rotatably mounted on the first support at a respective first bearing location and being rotatably mounted on the second support at a respective second bearing location, the first bearing locations being closer than the second bearing locations to the stranding point, each spool carrier having an axis of rotation that is perpendicular to the supports, the spool carriers being disposed circumferentially about the axis of the pipe.

2. The stranding machine of claim 1, wherein the first bearing locations are disposed relatively close to the pipe and the second bearing locations are disposed relatively far from the pipe, so that the axes of rotation of the individual spool carriers are oriented at an angle relative to the axis of the pipe.

3. The stranding machine of claim 2, further comprising means for directing filaments from the spools carried by the spool carriers inward toward the supporting pipe and for then diverting the filaments for movement in a direction generally parallel to the supporting pipe toward the first end thereof.

4. The stranding machine of claim 2, wherein the first support is closer than the second support to the first end of the pipe.

5. The stranding machine of claim 1, wherein the webs additionally have outer edges, the distance between the inner and outer edges of each web being greater than the diameter of the pipe.

6. The stranding machine of claim 1, wherein the webs additionally have outer edges, wherein the supports have outer edges, and wherein the distance between the pipe and outer edges of the supports, at least where the webs are connected to them, is approximately the same as the distance between the inner and outer edges of the webs.

7. The stranding machine of claim 1, further comprising:

means for providing a third support which is connected to the pipe and which encircles the pipe, the third support being spaced apart from the second support and being configured so that a cross section taken through the third support, along a plane containing the axis of the pipe, has two straight segments that are symmetrical with respect to the axis of the pipe and that are inclined so as to be oriented at an angle other than 90° to the axis of the pipe;

a plurality of further spool carriers for the spools, each further spool carrier being ratably mounted on the third support at a respective third bearing location and being rotatably mounted on the second support at a respective fourth bearing location, the fourth bearing locations being closer than the third bearing locations to the stranding point, each further spool carrier having an axis of rotation that is perpendicular to the second and third supports, the further spool carriers being disposed circumferentially about the axis of the pipe;

means for rotating each further spool carrier about its axis of rotation; and means, disposed adjacent the second support, for transferring the rotation of each further spool carrier to a respective one of the spool carriers that are mounted on the first and second supports so that said respective one of the spool carriers that are mounted on the first and second supports rotates about its axis of rotation; and wherein the means for providing a plurality of longitudinal webs additionally comprises means for providing longitudinal webs that are connected to the second and third supports.

8. The stranding machine of claim 7, further comprising first and second bearing means for supporting the pipe, the first bearing means being disposed adjacent the first end of the pipe and the second bearing means being disposed adjacent the second end of the pipe, all of the supports being disposed between the first and second bearing means.

9. The stranding machine of claim 1, further comprising first and second baring means for supporting the pipe, the first bearing means being disposed adjacent the first end of the pipe and the second bearing means being disposed adjacent the second end of the pipe.

10. A cage-type stranding machine for use with spools of filaments which are to be stranded, the stranding machine having a standing point where the filaments converge, comprising:

a rotatably mounted supporting pipe having first and second ends and having an axis which runs through the first and second ends, the stranding point of the stranding machine being adjacent the first end of the pipe, at least three longitudinal webs which extend in the longitudinal direction of the pipe and which have inner edges abutting the pipe, the webs being oriented radially outwardly from the pipe and being distributed uniformly about the circumference of the pipe, at least three first supporting shields fixed to the webs, with a first supporting shield being disposed between each two adjacent webs, the first supporting shields having inner edges which are oriented toward the pipe and which lie on a common inner circumferential path and having outer edges which are oriented away from the pipe and which lie on a common outer circumferential path, the first supporting shields being inclined so as to be oriented at an angle other than 90° to the axis of the pipe, at least three second supporting shields which are spaced apart from the first support shields and which are fixed to the webs, with a second supporting shield being disposed between each two adjacent webs, the second supporting shields having inner edges which are oriented toward the pipe and which lie on a common inner circumferential path and having outer edges which are oriented away from the pipe and which lie on a common outer circumferential path, the second supporting shields being inclined so as to be oriented at said angle other than 90° to the axis of the pipe, and a plurality of spool carriers for the spools, each spool carrier being rotatably mounted on a first supporting shield at a respective first bearing location and being rotatably mounted on a second supporting shield at a respective second bearing location, the first bearing locations being closer than the second bearing locations to the stranding point, each spool carrier having an axis of rotation that is perpendicular to the supporting shields on which it is mounted, the spool carriers being disposed circumferentially about the axis of the pipe.

11. The stranding machine of claim 10, wherein the first bearing locations are disposed relatively close to the pipe and the second bearing locations are disposed relatively far from the pipe, so that the axes of rotation of the individual spool carriers are oriented at an angle relative to the axis of the pipe.

12. The stranding machine of claim 11, wherein the first supporting shields are closer than the second supporting shields to the first end of the pipe.

13. The stranding machine of claim 11, further comprising means for directing filaments from the spools carried by the spool carriers inward toward the supporting pipe and for then diverting the filaments for movement in a direction generally parallel to the supporting pipe toward the first end thereof.

14. The stranding machine of claim 10, wherein the first and second supporting shields that are disposed between the same two adjacent webs have planar surfaces and are parallel to one another.

15. The stranding machine of claim 10 in combination with a removal device for the stranded filaments, wherein the stranding machine further comprises measuring means for sensing centrifugal force acting on a spool which is mounted on a respective spool carrier, the measuring means being disposed adjacent the respective spool carrier, and means, responsive to the measuring means, for controlling the rpm of the pipe and for controlling the rate of removal by the removal device.

16. The stranding machine of claim 15, wherein the measuring means is positioned at a second bearing location.

17. The stranding machine of claim 10, wherein the webs additionally have outer edges, the distance between the inner and outer edges of each web being greater than the diameter of the pipe.

18. The stranding machine of claim 10, wherein the webs additionally have outer edges, and wherein the distance between the inner and outer edges of the supporting shields, at least where they are fixed to the webs, is approximately the same as the distance between the inner and outer edges of the webs.

19. The stranding machine of claim 8, wherein each supporting shield comprises a respective flat plate with two side edges which extend from the inner edge of the respective supporting shield to the outer edge of the respective supporting shield, each side edge having a straight portion, the straight portions of the side edges being disposed at an acute angle to one another and being in contact with adjacent webs.

20. The stranding machine of claim 10, further comprising:

at least three third supporting shields fixed to the webs, with a third supporting shield being disposed between each two adjacent webs, the third supporting shields having inner edges which are oriented toward the pipe and which lie on a common inner circumferential path and having outer edges which are oriented away from the pipe and which lie on a common outer circumferential path, the third supporting shields being inclined so as to be oriented at said angle other than 90° to the axis of the pipe;

a plurality of further spool carriers for the spools, each further spool carrier being rotatably mounted on a third supporting shield at a respective third bearing location and being mounted on a second supporting shield at a respective fourth bearing location, the fourth bearing locations being closer than the third bearing locations to the stranding point, each further spool carrier having an axis of rotation that is perpendicular to the supporting shields on which it is mounted, the further spool carriers being disposed circumferentially about the axis of the pipe;

means for rotating each further spool carrier about its axis of rotation; and means, disposed adjacent the second supporting shields, for transferring the rotation of each further spool carrier to a respective one of the spool carriers that are mounted on the first and second supporting shields so that said respective one of the spool carriers that are mounted on the first and second supporting shields rotates about its axis of rotation.

21. The stranding machine of claim 20, further comprising first and second bearing means for supporting the pipe, the first bearing means being disposed adjacent the first end of the pipe and the second bearing means being disposed adjacent the second end of the pipe, all of the supporting shields being disposed between the first and second bearing means.

22. The stranding machine of claim 10, further comprising first and second bearing means for supporting the pipe, the first bearing means being disposed adjacent the first end of the pipe and the second bearing means being disposed adjacent the second end of the pipe.

* * * * *